United States Patent [19]

Shimamune et al.

[11] 4,122,317

[45] Oct. 24, 1978

[54] MULTI-CIRCUIT SWITCH

[75] Inventors: Shoji Shimamune; Yoshimi Kamijo, both of Furukawa, Japan

[73] Assignee: Alps Electric Co., Ltd., Japan

[21] Appl. No.: 786,981

[22] Filed: Apr. 13, 1977

[30] Foreign Application Priority Data

Apr. 14, 1976 [JP] Japan ..... 51-42270

[51] Int. Cl.[2] ..... H01H 15/02

[52] U.S. Cl. ..... 200/16 F

[58] Field of Search ..... 200/16 C, 16 D, 16 F, 200/254

[56] References Cited

U.S. PATENT DOCUMENTS

| | | | |
|---|---|---|---|
| 3,643,043 | 2/1972 | Endow | 200/16 F |
| 3,729,600 | 4/1973 | Solomon et al. | 200/16 D |
| 3,963,884 | 6/1976 | Pollock | 200/16 D |
| 3,974,347 | 8/1976 | Lockard | 200/16 D |
| 4,016,377 | 4/1977 | Iwasaki | 200/16 F |
| 4,031,345 | 6/1977 | Garcia | 200/16 C X |

*Primary Examiner*—James R. Scott

*Attorney, Agent, or Firm*—Guy W. Shoup; Gerard F. Dunne

[57] ABSTRACT

A multi-circuit switch is described which comprises a housing divided into a desired number of chambers, a base member fixed to one end of the housing, sliders disposed in respective chambers for sliding movement, stationary contact elements disposed in spaced relation on the base member and contained in the respective chambers, and movable contact elements attached to the respective sliders for engaging and dis-engaging each pair of the stationary contact elements as the corresponding slider is moved. The movable contact elements each have contact portions bifurcated in a clip shape for holding therebetween one or both of the stationary contact elements.

1 Claim, 7 Drawing Figures

(b)

MULTI-CIRCUIT SWITCH

BACKGROUND OF THE INVENTION

The invention relates to an improved miniature multi-circuit switch for direct attachment to a printed-circuit base plate.

Various types of miniature switches adapted for direct attachment to a printed-circuit base plate, which are generally referred to as D.I.P. switches, have been proposed in the past. One type thereof is illustrated in FIG. 5 in which a rocking type operating button 21 can be pressed and rotated so as to move a movable contact 22, provided by a metal ball fitted into a recess formed in the operating button 20, and bring a spring contact terminal 24 into contact with a stationary terminal 23*a* or 23*b*, selectively. Another type D.I.P. switch is illustrated in FIG. 6 in which a rocking type operating button 25 can be pressed and rotated about a pin 26 so as to bring two spring contact terminals 27*a* and 27*b* into and out of engagement so that the switch can be closed and opened. Still another type of D.I.P. switch is shown in FIG. 7 in which a lever 28 can be rotated about a pin 29 so that two spring contact terminals 30*a* and 30*b* can be connected and disconnected from each other. Such switches cannot be made in a multi-circuit form without much labor and time when many switches are to be arranged and assembled in a switch frame. Furthermore, in such a switch, the contacts have only one side having a part in contact action and thus have a tendency to become loose in a number of switching operations. Accordingly, such switches are poor in contact stability.

SUMMARY OF THE INVENTION

Therefore, it is an object of the present invention to provide an improved miniature multi-circuit switch adapted for direct attachmet to a printed-circuit base plate and which will be free from the above-mentioned and other disadvantages of the prior art switches.

Another object of the present invention is to provide an improved miniature multi-circuit switch which can be made economically on a mass production basis.

Still another object of the present invention is to provide an improved miniature multi-circuit switch which has increased reliability and life.

A further object of the present invention is to improve the contact stability of the switch and the electrical properties thereof.

In accordance with the present invention, there is provided a miniature multi-circuit switch comprising a housing divided into a desired number of chambers, a base member fixed to an open end of the housing, sliders disposed in the respective chambers for sliding movement, stationary contact elements for each respective chamber and disposed in spaced relation on the base member, and movable contact elements attached to the respective sliders for alternatively engaging and disengaging the stationary contact elements as the corresponding slider is moved. The movable contact elements each have bifurcated contact portions in a clip shape for holding therebetween one or both of the stationary contact elements.

The stationary contact elements are made by punching a stationary contact member formed integrally with main portions, contact portions, terminal portions, and a lead frame to which the ends of the terminal portions are connected; and then turning up the contact portions, bending the main portions at a right angle, and cutting the terminal portions to separate the lead frame from the terminal portions after the switch is assembled.

BRIEF DESCRIPTION OF THE DRAWINGS

For a better understanding of this invention, together with other and further objects thereof, reference is now made to the following description taken in conjunction with the accompanying drawings, in which:

FIG. 4 (*b*) is a perspective view of the stationary terminal members with their main portions being bent at a right angle.

DETAILED DESCRIPTION OF THE INVENTION

Figure 1:
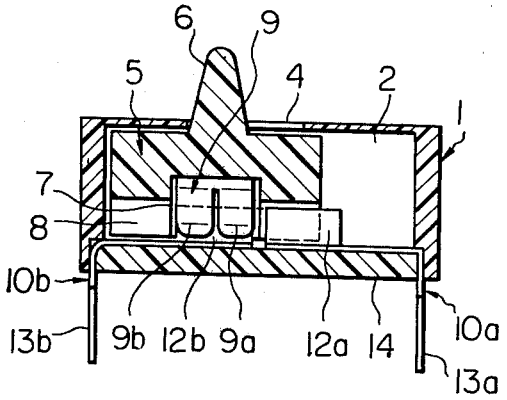
FIG. 1 is a sectional view of a miniature multi-circuit switch in accordance with the present invention.
Figure 2:
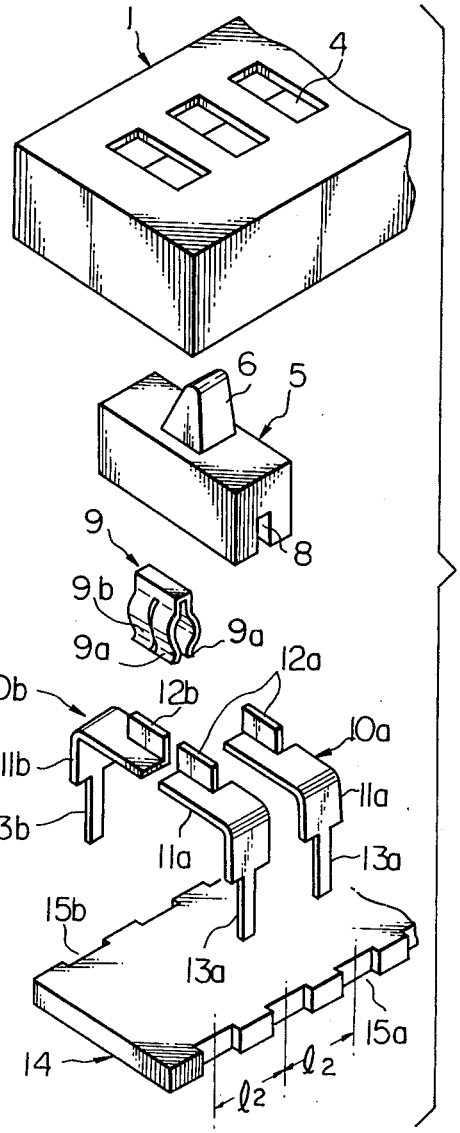
FIG. 2 is a perspective view of the switch of FIG. 1 in an exploded form.
Figure 3:
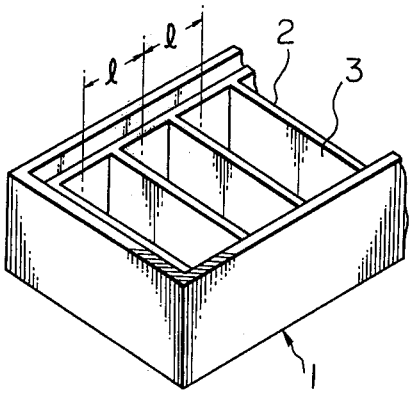
FIG. 3 is a perspective view of the housing as viewed from an open or bottom end thereof.

Reference is now made to FIGS. 1 through 3 wherein a miniature multi-circuit switch in accordance with the present invention is illustrated. The switch includes a housing having over its one end a cover plate formed with openings 4. The housing 1 may be formed of an electrically insulating synthetic resin and is divided by means of partition plates 2 into a desired number of equally sized chambers 3. Placed for sliding movement in each of the chambers 3 is a respective slider 5 formed of a synthetic resin. The slider 5 is provided on its upper surface with a button 6 and is formed in its lower surface with a recess 7 for attachment of a clip-shaped movable contact element 9, and in its lower surface with a groove 8 in which the contact portions 12*a* and 12*b* of stationary contact elements 10*a* and 10*b* are positioned. The button 6 projects through the opening 4 of the cover plate when assembled. The movable contact element 9 is formed of a resilient metal plate, for example, such as phosphor bronze, silver-plated plate curved into a clip shape. The movable contact element 9 is formed integrally with its contact portions 9*a* and 9*b* in a clip shape and positioned in the recess 7 of the slider 5 so that the contact portions 9*a* and 9*b* can slide onto both surfaces of the stationary contact portions(s) 12*a* and/or 12*b* in pressure contact therewith when the slider 5 moves in the chamber 3.

Each of the stationary contact elements 10*a* and 10*b* is formed of a nickel silver plate and formed integrally with main portions 11*a* and 11*b* bent at right angles, a stationary contact portion 12*a* or 12*b* upturned, and a terminal portion 13*a* or 13*b* extending from the main portion. By engaging the main portions 11*a* and 11*b* into the recesses 15*a* and 15*b* formed symmetrically in the opposite sides of an insulating base plate 14, the stationary contact elements 10*a* and 10*b* are set on the base plate 14 so that the stationary contact portions 12*a* and 12*b* lie in a common plane. The insulating base plate 14 is formed with the recesses 15*a* and 15*b* equal in number to the chambers 3 of the housing 1. The depth and width of the recesses are substantially equal to the thickness and width of the main portions, respectively. The insulating base plate 14 is fitted in the other or open end of the housing 1 and fixed thereto such as by adhesive or other suitable means.

Figure 4:
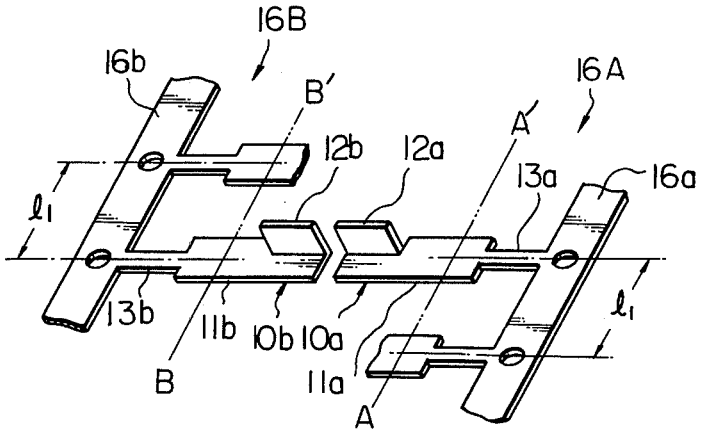
FIG. 4 (*a*) is a perspective view of the stationary terminal members of the switch.
Figure 4:
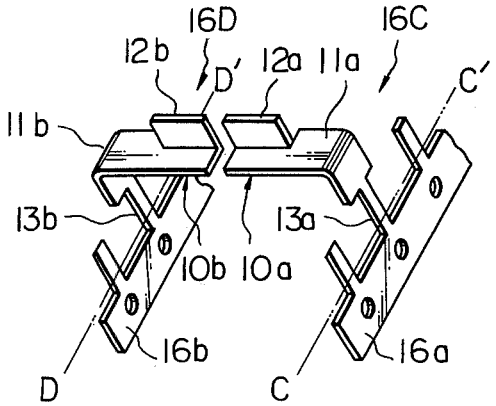
Figure 5:
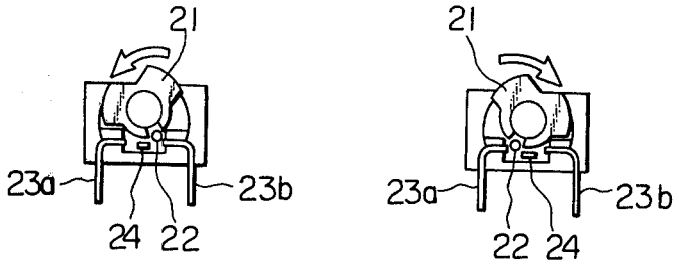
FIGS. 5 through 7 show examples of conventional D.I.P. switches.
Figure 6:
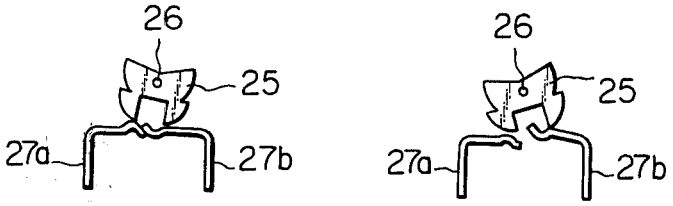
Figure 7:
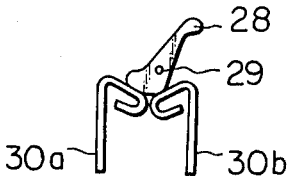

The stationary contact elements 10 are not formed independently or one by one, but they are formed by punching a metal band into generally a comb shape and then bending up the contact portions 12 so as to integrally form the main portions 11, the upturned contact portions 12, the terminal portions 13, and a lead frame 16 to which the terminal portion ends are connected as shown in FIG. 4(*a*), and then bending the main portions at a right angle along the line A—A and the line B—B as shown in FIG. 4(*b*), and finally cutting the terminal portions 13 to separate the lead frame 16 from the terminal portions 13 along the line C—C and the line D—D after the switch is assembled. The distance between the center lines of any two adjacent terminal portions 13 is designed to be equal to the distance between the center lines of any two adjacent recesses 15 formed in the side of the insulating base plate 14 and also to the distance between the center lines of any two adjacent chambers 3.

The assembly of the switch described in connection with FIGS. 1 through 4 will be described as follows: First, each of the movable contact elements 9 is fitted into the recess 7 of a respective slider 5 so as to be held therein for sliding movement between the contact portions of the stationary contact elements which have been set on the insulating base plate 14. Then, the sliders 5, each having a movable contact element 9, are placed in the respective chamber 3 of the housing 1 with the buttons projecting from the openings 4 of the cover plate, and the insulating base plate 14 is fixed to the open end of the housing 1 so that the movable contact elements 16 are held between the lower end portion of the housing 1 and the insulating base plate 14 so as to be firmly fixed. Finally, the terminal portion ends 13 are cut along the line C—C and the line D—D to separate them from the lead frames 16*a* and 16*b* by use of a cutter or the like so that the respective stationary terminal portions 10 are electrically separated and a unit switch is thus constructed for each chamber 3.

The operation of the switch described in this embodiment will now be described. When the button 6 of the slider 5 abuts to the left edge of the opening 4 formed in the housing 1 as shown in FIG. 1, the movable contact element 9 is in contact with one stationary contact portion 12*b* only and the switch is in the "OFF" condition. When the button 6 is pushed to move in the right direction of the drawing together with the slider 5 until the button 6 abuts to the right edge of the opening 4, the contact portions 9*a* of the movable contact element 9 come into contact with the stationary contact portion 12*a* and the contact portions 9*b* thereof remain in contact with the stationary contact portion 12*b* and the switch is placed in the "ON" condition. When the button 6 is pushed to move leftwards the movable contact element 9 moves to return the switch to the "OFF" condition.

As described above, in the miniature multi-circuit switch of the present invention, the respective stationary contact elements are not set on the base plate one by one, but are all set thereon at one time by the use of the integrally formed contact elements. This construction makes mass production possible, further, uniform quality and low cost is assured. This special feature of the present invention becomes important in producing multi-circuit switches having an increased number of unit switches. Also, the contact portions 9*a* and 9*b* of the movable contact element 9 are designed in a clip shape so as to hold therebetween the opposite surfaces of the contact portion(s) 12*a* and/or 12*b* in pressure contact therewith. This construction can accomplish a sure contact between the movable and stationary contact elements and provides a superior contact stability in comparsion with the conventional switches in which only one surface of the contact element has a part in contact action. Thus, the present invention can improve the productivity and electrical properties of the miniature multi-circuit switch to a great extent.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. A multi-circuit switch assembly suitable for use with a printed circuit board or the like, comprising a housing comprised of an electrically insulating material and divided into a predetermined number of chambers, said housing being open at one end thereof and having a cover member at the other end thereof, said cover member having a number of openings each being associated with a respective chamber;

a number of sliders each adapted to be disposed in a respective chamber for sliding movement therewithin, said sliders each having a button member adapted to extend through a respective opening in said cover member and operable for actuation of said slider;

movable contact elements attached to respective sliders, each said movable contact element having clip-like portions having opposing inner contact surfaces;

a base member comprised of an electrically insulating material and adapted to be affixed to said open end of said housing, said base member having a number of recesses along opposing sides thereof; and stationary contact members carried by said base member and each integrally formed with main portions adapted to lie upon said base, contact portions upturned from respective main portions and adapted to be engaged by movable contact elements, said contact portions having opposing outer surfaces each adapted to be engaged by the corresponding inner contact surfaces of respective clip-like portions, terminal portions extending downwardly from respective main portions to terminal end portions, said terminal portions each extending within a respective one of said recesses, and a lead frame interconnecting terminal end portions; whereby said assembly may be assembled by disposing said sliders and associated movable contact elements into respective chambers with said button members extending through respective ones of said openings in said cover member, fitting said base member carrying said stationary contact member into said open end of said housing, and then separating said lead frame from said terminals end portions.

* * * * *